US007634901B2

(12) United States Patent
Marcellus

(10) Patent No.: US 7,634,901 B2
(45) Date of Patent: Dec. 22, 2009

(54) ISOTROPIC RECYCLING ENGINE

(75) Inventor: Saint-Ange Marcellus, 38 Nelson Dr., Randolph, MA (US) 02368

(73) Assignee: Saint-Ange Marcellus, Randolph, MA (US)

( * ) Notice: Subject to any disclaimer, the term of this patent is extended or adjusted under 35 U.S.C. 154(b) by 595 days.

(21) Appl. No.: 11/361,744

(22) Filed: Feb. 24, 2006

(65) Prior Publication Data

US 2009/0120097 A1 May 14, 2009

Related U.S. Application Data

(60) Provisional application No. 60/654,884, filed on Feb. 23, 2005.

(51) Int. Cl.
*F02C 7/08* (2006.01)

(52) U.S. Cl. ..... 60/39.52; 60/651; 60/671

(58) Field of Classification Search ..... 60/39.52, 60/772, 651, 671, 672, 682, 683
See application file for complete search history.

(56) References Cited

U.S. PATENT DOCUMENTS 4,237,689 A * 12/1980 Sampietro ..... 60/599
4,550,562 A * 11/1985 Rice ..... 60/772
6,069,726 A * 5/2000 Hughes ..... 359/223
6,348,278 B1 * 2/2002 LaPierre et al. ..... 429/17
7,069,726 B2 * 7/2006 Frutschi ..... 60/772

* cited by examiner

*Primary Examiner*—Michael Cuff
*Assistant Examiner*—Phutthiwat Wongwian

(57) ABSTRACT

An engine or motor that generates electrical energy by the use of isotropic principles in conjunction with the expansion of fuel materials when constant heat is applied to flammable fuels such as propane, nitrogen, alcohol, diesel fuel and ammonia water in a well structured mechanical setting.

2 Claims, 1 Drawing Sheet

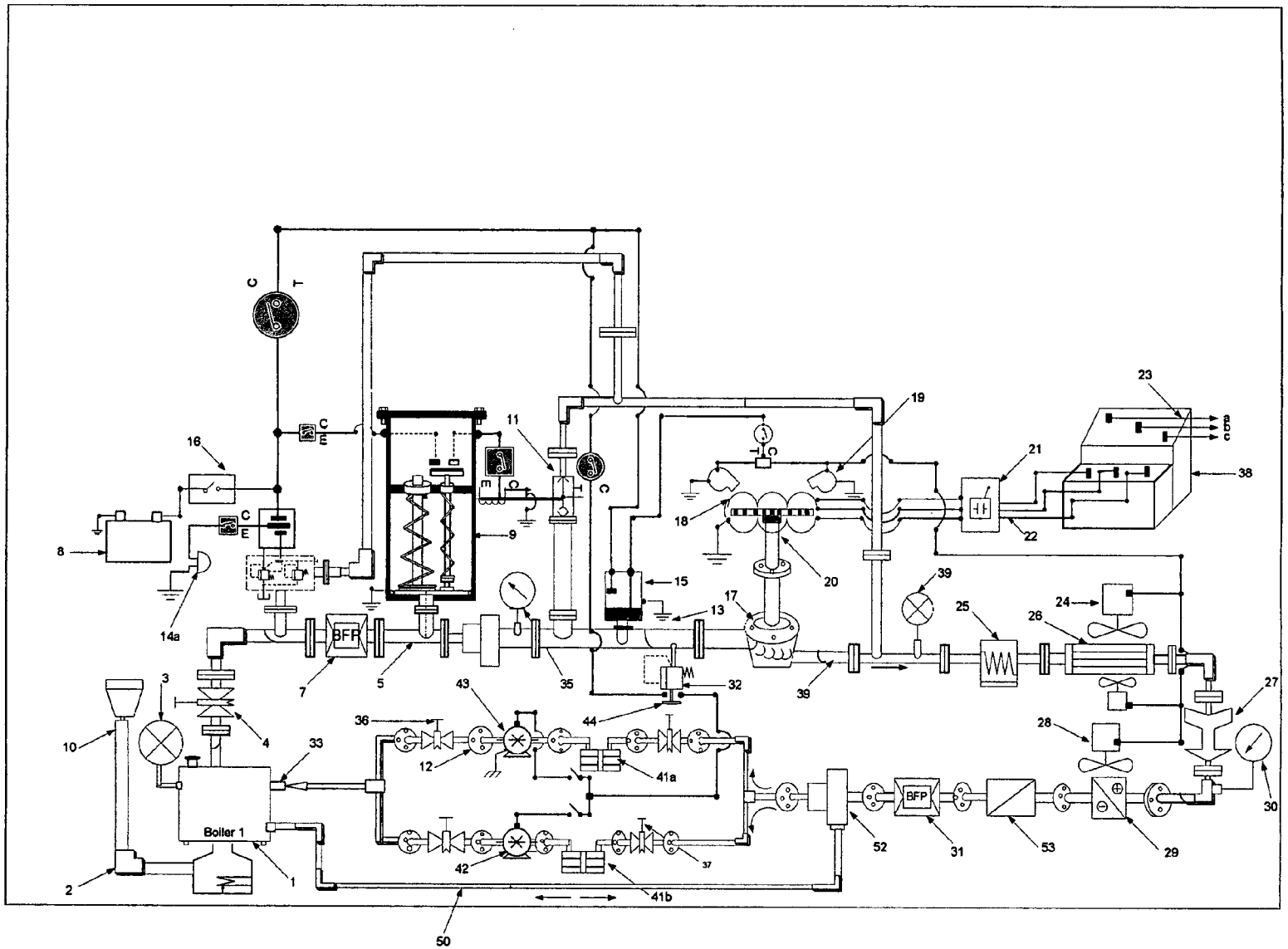
Boiler 1
BFP
BFR

ISOTROPIC RECYCLING ENGINE

CROSS-REFERENCE TO RELATED APPLICATIONS

Priority is claimed under 35 USC §119(e) to the provisional patent application 60/654,884 filed on Feb. 23, 2005.

BACKGROUND OF INVENTION

The price of oil energy is rising, and it is unlikely that the price will come down soon. The pollution caused by the burning of fossil fuels is worrisome. The continuing availability of fossil fuels is becoming questionable. Thus, it is imperative that the fuel economy of all vehicles that use fossil fuel to power them be enhanced whenever possible. Thus was born the idea of an Isotropic Recycling Engine.

SUMMARY OF INVENTION

The Isotropic Recycling Engine is a fuel recycling motor that is built to run on the isotropic principle. The definition of isotropic is as follows "exhibiting properties (as velocity of light transmission) with the same values when measured along axes in all directions". Thus, in this device, the isotropic principles are used in conjunction with the expansion of fuel materials when constant heat is applied to flammable fuels such as propane, $C_3H_8$, nitrogen, alcohol, diesel fuel and ammonia water in a well structured mechanical setting.

BRIEF DESCRIPTION OF THE DRAWINGS

FIG. 1 depicts the Isotropic Recycling Engine as fully configured.

DESCRIPTION OF THE INVENTION

The terminology used herein should be interpreted in its broadest reasonable manner, even though it is being utilized in conjunction with a detailed description of a certain specific preferred embodiment of the present invention. This is further emphasized below with respect to some particular terms used herein. Any terminology that the reader should interpret in any restricted manner will be overtly and specifically defined as such in this specification. The preferred embodiment of the present invention will now be described with reference to the accompanying drawings, wherein like reference characters designate like or similar parts throughout.

Thermodynamic vs. Kinetic vs. Electrical Energy

With reference to FIG. 1, when heat is applied to the combustion unit 1, by way of a furnace 2 or other means, the fuel or liquid in the combustion unit will increase in volume due to the isotropic property of liquid materials. This change in volume will require a larger area than the combustion unit 1 for the expansion of the fuel. This is in accordance with fundamental principles first postulated by Blaise Pascal who stated that "pressure applied on a contained fluid is transmitted undiminished in all directions, and acts with equal force on equal area, and at right angles to them". The thermodynamic energy being created in the combustion unit (which is an equivalent of kinetic energy), and monitored by a pressure gauge attached to it 3, is forced through the combustion unit's outflow port, through a main valve 4, through a first back flow preventer valve 47 through a super-heater 40 (with accompanying high pressure gauge 10) by way of a main conduit 5 and is trapped by the turbine plates of the turbine 17. The trapped energy immediately develops pressure inside the turbine 17 and turns the turbine blades. A heavy spring loaded balancing weight 9 is placed inline to the device, along with a pressure control bypass safety valve 11, so that the turbine 17 will move first when the pressure (though the use of thermodynamics) is applied to the system. The turbine changes the kinetic or thermodynamic energy into mechanical energy and is attached to a generator 18 which transfers the energy into electrical energy via rotors 20, centrifugal fans 19 through a transformer main switch 21 and primary lines 22 to a transformer 38. The combustion unit 1 has a drain plug 44 for maintenance use, and a chimney 50 to draw air into the combustion unit 1. There are electrical circuit components to this device which will be discussed in turn below. However, at the main control unit level, there are a main switch 16, a battery 8 for power redundancy, and a main pressure relief valve 6 and a ground 51 (which is used as the ground for all components).

Cooling System and Recycle Circuit

After the high pressure fuel vapor passes through the moving turbine 17, it is forced, through the use of conduit 5 such as a standard PVC pipe or copper tubing, through a compressor 25 and into a condenser 26. A low pressure line gauge 39 is placed inline to monitor appropriate fuel vapor pressures from the turbine 17 to the compressor 25 and another pressure gauge 35 is used to monitor the pressure in the line just before the condenser. At the condenser and through the use of condenser fans 24 the heat begins to dissipate. However, not all heat dissipates at the condenser 26 and in fact a flow control valve 27 opens to allow the fuel vapor to continue to a heat exchanger 29 where the rest of the heat is dissipated through the heat exchanger 29 and the heat exchanger fans 28. A pressure gauge is placed inline to monitor appropriate fuel vapor pressures.

After the heat exchanger 29 a flow control pump 31 is installed in the low pressure line followed by a back flow preventer valve 47 to ensure that the fuel vapor is pumped only one way—and that way is back towards the combustion unit in this subsystem circuit. A pre-heater 52 is employed to heat the fuel vapor on its way back to the combustion unit for re-use. Additionally, a pressure control regulator 32, several bypass valves 36 and 37, two reservoirs 41*a*, 41*b*, two injection pumps 42 and 43, several regular valves 33 and 34 and an injector 46 are used to complete this cooling/recycling circuit. The injector 46 is used to inject the condensed and heated fuel vapor back into the combustion unit, via an injector port, for reuse as a fuel. Thus, through the use of this electromechanical sub-system, some of the fuel vapor returns to the combustion unit for reuse.

Pressure Control Regulator

If the pressure in the entire system is becoming too high, which in turn would cause the turbine to spin too fast the heavy load balancing pressure will close the contact 13*a* to operate the solenoid 12 to open gate 11. Pressure will divert to the secondary line bypassing the turbine axle. If the system is under pressured the pressure control regulator 32 will engage to close the pressure control regulator contact 48 to activate the injection pumps 42 and 43 to feed the combustion unit with the recycled fuel vapor and thus boost the pressure in the system through the injector 46 to repeat the cycle.

Temperature Control Relay

A thermometer relay switch 15, which in this implementation is a typical mercuric thermometer switch, is located between the pressure bypass gate (X) and the turbine 17. This thermometer relay switch controls the temperature inside the generator by turning the centrifugal fans 19 on or off, as appropriate, to cool the generator. It is envisioned that other temperature sensitive relays could be used, such as a thermocouple type thermal relay.

Motor Size, Power and Specifications

The motor's size and power delivery will depend on the desires and capacity of the manufacturers and the energy demanded from this system. With a redesign of typical hydrocarbon fueled engines or motors, this Isotropic Recycling Engine can by used as the primary method with which to power cars, trucks, trains and even conveyors and the like in any mechanical setting where force is required to produce a result.

Efficiency

This motor is made to be more efficient than any other motor that has been built. For example, if 120 gallons of diesel fuel is placed into the burner and run for 12 hours, virtually the same amount of fuel will be in device at the end since the engine/device does not consumer the fuel. The expected amount of fuel at the end of 12 hours is 119.8 gallons, and thus the lost would only be 1% and said loss is primarily due to heat loss and the chemical reactions of the fuel itself.

Other engines or motors such as the traditional gas engine, hydraulic engines consume fuel and water without the capacity to recycle the "fuel" material, and thus the "loss" of the more traditional engine systems is 100%. The Isotropic Recycling Engine is nearly 100% efficient in terms of energy conservation and work produced and thus is a necessary invention to solve some of the energy problems that beset the 21$^{st}$ century.

The foregoing description details certain preferred embodiments of the present invention and describes the best mode contemplated. It will be appreciated, however, that no matter how detailed the foregoing description appears, the invention can be practiced in many ways without departing from the spirit of the invention. Therefore, description contained in this specification is to be considered exemplary, rather than limiting, and the true scope of the invention is only limited by the following claims and any equivalents thereof.

What is claimed is:

1. An isotropic recycling engine comprising:

a fuel source comprised of compounds capable of being ignited;

a combustion unit contains the fuel source, wherein said fuel source is heated by a furnace to produce a high pressure vaporized fuel;

a chimney configured to draw air into the combustion unit;

a main conduit fluidly coupled to the combustion unit;

a heavy spring loaded balance weight positioned downstream from the combustion unit and fluidly coupled to the main conduit;

a pressure control bypass solenoid activated by the heavy spring loaded balancing weight;

a turbine coupled to the main conduit and configured to extract energy from the fuel source, wherein the turbine is connected to a generator which transfers mechanical energy into electrical energy via rotors;

a compressor located downstream from the turbine and in line with the main conduit;

a condenser located downstream from the compressor and in line with the main conduit;

a low pressure line fluidly coupled to the main conduit;

a pump installed in the low pressure line followed by a back flow preventer valve; and a pre-heater configured to heat the high pressure vaporized fuel on its way back to the combustion unit.

2. The isotropic recycling engine as recited in claim 1, further comprising an injector coupled to the pre-heater for injecting the high pressure vaporized fuel into the combustion unit.

* * * * *